United States Patent [19]

Brenneman et al.

[11] Patent Number: 4,798,577

[45] Date of Patent: Jan. 17, 1989

[54] SEPARATOR DEVICE AND METHOD

[75] Inventors: Allen J. Brenneman, Elkhart; Harvey B. Buck, Jr., Indianapolis; Jerry T. Pugh; Steven P. Robertson, both of Elkhart, all of Ind.

[73] Assignee: Miles Inc., Elkhart, Ind.

[21] Appl. No.: 862,301

[22] Filed: May 12, 1986

[51] Int. Cl.[4] ..... B04B 1/04

[52] U.S. Cl. ..... 494/67; 494/43; 494/80

[58] Field of Search ..... 494/17, 37, 38, 42, 494/60, 64, 66, 67, 79, 80, 40, 43, 41, 48, 56; 366/306

[56] References Cited

U.S. PATENT DOCUMENTS

| | | | |
|---|---|---|---|
| 873,593 | 12/1907 | Phillips | 494/67 |
| 3,096,283 | 7/1963 | Hein | 494/38 |
| 3,813,031 | 5/1974 | Anderson | 494/43 |
| 3,847,327 | 11/1974 | Erikson et al. | 494/67 |
| 3,864,089 | 2/1975 | Tiffany et al. | 494/17 |
| 4,094,461 | 6/1978 | Kellogg et al. | 494/43 |
| 4,295,600 | 10/1981 | Saget | 494/67 |
| 4,330,080 | 5/1982 | Mathieu | 494/43 |
| 4,479,789 | 10/1984 | Steimel | 494/64 |
| 4,512,759 | 4/1985 | Alink et al. | 494/40 |

FOREIGN PATENT DOCUMENTS

| | | | |
|---|---|---|---|
| 425665 | 4/1974 | U.S.S.R. | 494/67 |
| 499275 | 1/1939 | United Kingdom | 494/68 |

*Primary Examiner*—Timothy F. Simone
*Assistant Examiner*—Corinne M. Reinckens
*Attorney, Agent, or Firm*—Roger N. Coe

[57] ABSTRACT

Separation device and method for the fractionation and separation of finely divided solid particulate material suspended in a liquid are disclosed. The separation device comprises upper and lower portions which are joined together to form an inner cavity retaining liquid and a capillary gap which extends outwardly radially from said cavity. During rotation solid particles present in the suspending liquid pass outwardly along and/or become entrapped in the capillary gap(s).

7 Claims, 5 Drawing Sheets

SEPARATOR DEVICE AND METHOD

FIELD OF THE INVENTION

The present invention relates to a centrifuge device and method for the fractionation and separation of finally divided solid particulate materials suspended in liquid. The device and method have special applicability for fractionating and separating biological particulate material from suspending liquid, e.g., plasma, salinic solutions, and the like. Accordingly, an important embodiment is the fractionation and separation of cellular components from whole blood.

BACKGROUND OF THE INVENTION

In general, centrifuge devices and methods designed to separate finely divided particulate material from suspending liquid are well-known. Such devices and methods have been utilized for the separation of solid blood components from whole blood or from a liquid blood fraction. While the present invention has broader utility than the separation of blood components, the invention will be illustrated in terms of embodiments relating to the separation of solid blood components.

Advances in assay techniques and analytical instrumentation has made it possible to carry out a variety of hematological, chemical and toxicological diagnostic procedures on very small quantities of blood. This offers a tremendous advantage since it obviates the need and skill required to withdraw veinuous blood from a patient. Instead, sufficient quantities of blood can now be obtained by the less traumatic procedure of collecting capillary source blood from a fingertip, ear lobe or the like.

Of particular interest are blood tests including glucose, LDH, SGOT, SGPT, BUN, total protein, phosphatase, bilirubin, calcium, chloride, sodium, potassium, and magnesium. Since such tests are normally performed on blood plasma, blood cells should be removed from whole blood samples and the platelets should be reduced prior to analysis.

Typically, however, devices designed for fractionation and separation of cellular components from whole blood tend to be mechanically complicated, expensive, inefficient and difficult to clean or sterilize for use. Another difficulty with known centrifuge devices or methods is the time required to effect the separation of solid particulate material suspended in a liquid. In many diagnostic tests performed in a physician's office it is important to have a volume of plasma or serum from a sample of blood in as short a time as possible. To be able to give the results of office testing to the patient such testing must be completed within 10 to 15 minutes. Any longer period of time results in prolonged waiting for the patient and overcrowding of the physician's office. Typically, centrifuging techniques require about 10 minutes of spin time. This does not permit effective diagnostic testing in the physician's office. Accordingly, apparatus and a method are needed to allow much more rapid plasma or serum separation to be effected at low cost.

In U.S. Pat. No. 3,957,653 apparatus for collection, separation and isolation of blood is disclosed comprising a test tube in which blood sample is introduced. Each test tube has a complicated closure member which provides a hermetic seal of the contents within the test tube. According to the indicated procedure blood in the test tube is centrifuged to effect removal of thixotrope which passes through an aperture into a chamber present in the closure member. The thixotropic material flows under centrifugal stress to its density gradient level between the blood components where it comes to rest and then assumes a rigid thixotropic structure which acts as a barrier between the separated blood components. Not only is the structure of the disclosed apparatus complicated, but it is expensive to manufacture and requires a density gradient level to equilibrate between the blood components in order to achieve the desired separation. Accordingly, the procedure is time consuming and not an effective means of separating components of blood.

U.S. Pat. No. 4,509,941 discloses a centrifuge device having a liner composed of porous material for entrapping solid particles during rotation of the centrifuge device. While this particular centrifuge device is effective it tends to be expensive because of the need for multiple parts and the necessity for assembling these multiple parts. Moreover, the nature of the liner material is a limiting factor in the effectiveness of the device. The liner used to entrap solid particles which are present in a suspending liquid limits the usefulness of the device in that as soon as the fractionation procedure begins the liner designed to entrap solid particles become less and less receptive to entrapping additional particles.

The present invention is directed to a disposable, low cost device which effectively separates solid particulate materials suspended in a liquid very rapidly. The system is easy to use and can be operated by a technician or unskilled lay person.

SUMMARY OF THE INVENTION

An object of the present invention is to provide a centrifuge device and method for fractionating and separating finely divided solid particulate material suspended in a liquid.

Another object of the present invention is to provide a system for the rapid and effective fractionation and separation of cellular components from whole blood.

Still another object of the present invention is to provide a mechanically simple, inexpensive, reliable centrifuge device and method for fractionating and separating finely divided solid particulate material suspended in a liquid.

A further object of the present invention is to provide a disposable centrifuge device for fractionating and separating finely divided particulate material suspended in a liquid.

In accordance with the present, a centrifuge device and method are provided for fractionating and separating finely divided solid particulate material suspended in a liquid wherein the centrifugal device comprises means having both an upper and a lower portion for retention of the liquid to be fractionated as well as the finely divided solid particulate material which is separated from the liquid during the fractionation operation. The upper portion in conjunction with the lower portion forms a capillary pathway for the finely divided solid particulate material. The interior wall of the upper portion is preferably sloped at an acute angle of greater than about 30 degrees to vertical such that liquid sample is retained in the centrifuge device during the fractionation and separation operations. In use, sample liquid material is introduced into the centrifuge device and then the centrifuge device is rotated for 1,000 to 4,000 G minutes, and preferably for 2,000 to 3,000 G minutes, to effect the fractionation and separation of the finely divided solid particulate material suspended in the liquid sample. Measurement of the G force is made at the end of the capillary pathway which is the farthest from the center of the centrifuge device.

BRIEF DESCRIPTION OF THE DRAWINGS

Other and further objectives and features of the invention will be apparent to those skilled in the art from the following detailed description thereof taken in conjunction with the accompanying drawings in which.

DESCRIPTION OF THE PREFERRED EMBODIMENTS

The apparatus forming the subject matter of the present invention is characterized by enclosure means comprising upper and lower portions for retention of liquid to be fractionated. The upper portion prevents the liquid from being ejected from the centrifuge device during the fractionation operation.

Figure 1:
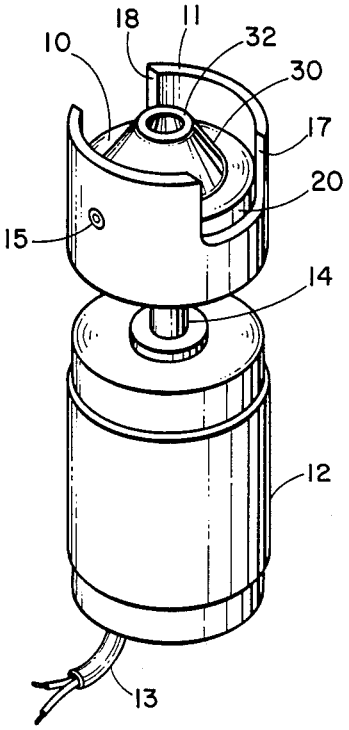
FIG. 1 is a perspective view of the centrifuge device of the present invention supported on a shaft of a high speed motor.

Referring now to FIG. 1 of the drawings, centrifuge device 10 of the present invention is shown inserted in a holder 11 which can be permanently attached to a high speed motor 12. Motor 12 is connected by means of line 13 to a suitable power source (not shown) and is designed to rotate holder 11 and hence centrifugal device 10 thereby bringing about the fractionation and separation of finely divided solid particulate material suspended in liquid inside centrifuge device 10. Holder 11 is attached to shaft 14 of motor 12 by suitable means, such as a set screw (not shown). Preferably, holder 11 is designed to conform closely to the outer configuration of centrifuge device 10 such that device 10 and holder 11 are held together by a friction fit which causes centrifuge device 10 to rotate when holder 11 rotates. If desired, however, centrifuge device 10 can be held in holder 11 by suitable means, such as set screw 15. For convenience, holder 11 can be designed with U-shaped cutaways surfaces 17 and 18 on opposite sides in order to facilitate the insertion and removal of centrifuge device 10 into and from holder 11 by means of a thumb and forefinger of one's hand.

Figure 2:
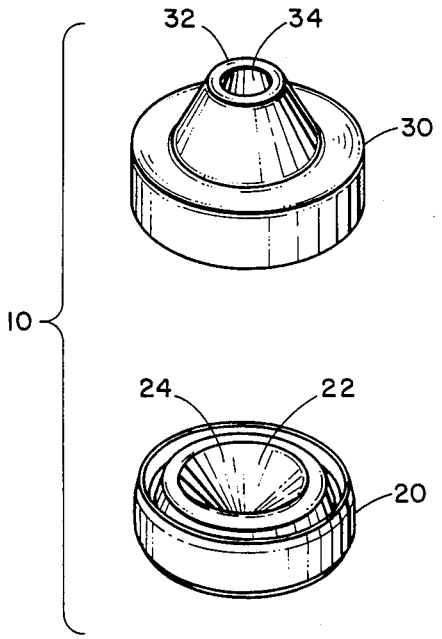
FIG. 2 is an exploded view of the centrifuge device of FIG. 1, illustrating certain components thereof, particularly the upper and lower portions of the centrifuge device.
Figure 3:
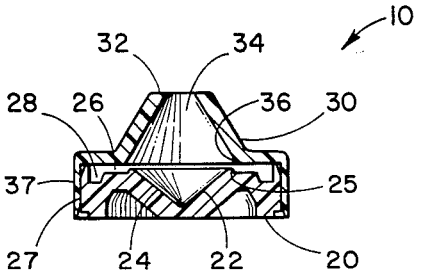
FIG. 3 is a side view, in cross section, of a centrifuge device of the present invention in its assembled form.

The construction of centrifuge device 10 is best seen in FIGS. 2 and 3. Centrifuge device 10 consists of a lower portion 20 with a conical base 22 designed for retention of liquid sample material in an inner cavity formed by sloping wall 24. The conical portion of sloping wall 24 generally forms an included acute angle ranging from 60 to 120 degrees and preferably an included acute angle of 90 to 110 degrees. Lower portion 20 in combination with upper portion 30 are designed in one preferred embodiment to hold approximately 0.5 to 0.8 milliliters (ml) of liquid to be fractionated. Said upper portion 30 is designed to engage lower portion 20 by nesting with lower portion 20 or resting on lower portion 20 in such a manner that the upper portion 30 will, when engaged with lower portion 20, form an assembly capable of retaining liquid inside centrifuge device 10. Generally, lower portion 20 and upper portion 30 are press fit together. Alternatively, these two elements can be sonic welded or adhesively bonded together. An o-ring or disk, made of suitable material, can also be used at the juncture of upper portion 30 and lower portion 20 so as to provide a liquid seal with respect to these two components of centrifuge device 10. Suitable deformable materials of low friction include polypropylene, polyethylene, nylon, polytetrafluroethylene, and the like. These deformable materials provide an effective seal between upper portion 30 and lower portion 20 during the centrifuge operation. While upper portion 30 can have many different shapes generally it will have an opening 32 for the introduction of liquid into centrifuge device 10 as well as for removal of fractionated liquid from centrifuge device 10. Normally, upper portion 30 will also have an interior sloping wall 34 extending from opening 32 downwardly at an angle of greater than about 30 degrees from vertical and preferably 40 degrees or greater from vertical such that end 36 of wall 34, which is opposite opening 32, is either directly above end 25 . of wall 24 of lower portion 20 or, preferably, end 36 is offset slightly from end 25 such that the flow of liquid traveling up wall 24 is not impeded until after it passes end 36 of upper portion 30. The length of wall 34 of upper portion 30 can vary, provided that the length is sufficient to assure that liquid is retained in centrifuge device 10 during the fractionation operation and that liquid is not expelled from any opening 32. It should be noted, however, as described in connection with the embodiment illustrated in FIGS. 10 and 11 that the length of the upper portion extending above the lower portion can vary significantly, depending on the particular configuration of both the upper and lower portions.

Upon assembly of lower portion 20 and upper portion 30 an area for retention of fluids is formed by wall 24 of lower portion 20 and wall 34 of upper portion 30. A capillary gap 26 is formed when upper portion 30 is joineed with lower portion 20. Capillary gap 26 (which can measure from about 5 to about 30 thousandths of an inch and preferably about 15 thousandths of an inch) extends horizontally from edge 25 of lower portion 20 toward the outer perimeter of lower portion 20 and can be connected with an annulus 28 which is inside outer wall 27 of cup 20. Thus, both annulus chamber 28 and capillary gap 26 are formed by the combination of lower portion 20 and upper portion 30 being joined together.

Because of the simplicity of the construction and the nature of the materials involved, the components of centrifugal device 10 can be made to be disposable after a single use. Alternatively, the design of centrifugal device 10 permits the components to be cleaned for reuse by simplying separating lower portion 20 from upper portion 30 and cleaning the respective parts. Lower portion 20 and upper portion 30 can be formed of any suitable material including metal, such as stainless steel, which can be cleaned and sterilized for reuse. However, typically these elements of centrifuge 10 are made of disposable plastic which is inert to the sample being fractionated. Suitable materials include polymeric materials such as polyolefin (polyethylene, polypropylene, etc.), polyvinylchloride, polyvinylenechloride, polyvinylacetate, polystyrene, polyacrylate (polymethylmethacrylate), polyester, polyamide (nylon 6 or nylon 66), polycarbonate or natural or synthetic rubbers and combinations thereof. Homopolymers, as well as copolymers, can be employed. A preferred material is Mobay Merlon Rx polycarbonate.

When the upper and lower portions are snap fitted together inner side wall 37 of upper portion 30 becomes engaged with outer side wall 27 of lower portion 20 such that upper portion 30 and lower portion 20 become interlocked and cannot be separated without considerable pressure being applied. By using molded plastic for the construction of these elements centrifuge device 10 becomes so inexpensive that it is disposable and it is not necessary to reuse the elements with attendant mandatory cleaning and/or sterilization prior to use of such elements.

In use, liquid to be centrifuged is introduced into centrifuge device 10 after upper portion 30 is attached to lower portion 20. Normally, upper portion 30 has an opening 32 for the introduction of liquid into centrifuge device 10. When the liquid has been inserted into the center of centrifuge device 10, the fractionation procedure can take place by inserting centrifuge device 10 into holder 11, tightening any retaining means, such as set screw 15, and then rotating centrifuge device 10 to effect the desired fractionation and separation of finely divided said particulate materials which are suspended in the sample liquid. It has been found that the centrifuge device 10 should be rotated from 1,000 to 4,000 G minutes and preferably for 2,000 to 3,000 G minutes when centrifuge device 10 is used as a separator for the fractionation and separation of cellular components from whole blood. Rotation of between about 10,000 and 14,000 rpm for 60 to 120 seconds will normally be sufficient. Generally, full acceleration is possible in ½ second and slow down can be accomplished in about 20 seconds. When rotation of centrifuge device 10 starts, whole blood moves outward along wall 24 due to the centrifugal force and up wall 34 such that the blood forms a layer along the tapered inside surfaces of centrifuge device 10. During rotation particulate material including cells, which are heavier than plasma or serum, migrate outward into the capillary gap 26 toward annulus 28 where they are retained. Thus, in the case of blood, red blood cells gravitate (or elutriate) in the direction of the centrifugal force, i.e., toward the outer extremity and cellular material passes along capillary gap 26 into any annulus 28 present. This migration tends to displace lighter components of blood which are forced inward. It has been found that in one preferred embodiment rotating centrifuge device 10 at a speed of at least 10,000 rpm for 60 seconds results in a cell free layer on the inside tapered surfaces of centrifuge device 10. Upon the completion of the centrifuge operation, liquid returns to the lowest point of lower portion 20, namely, conical cavity 22, formed by wall 24, and the cellular material remains in annulus 28 and/or capillary gap 26. Liquid, substantially free of such cellular material, can be withdrawn from centrifugal device 10, by inserting any suitable means, such as a pipette or syringe (not shown), through opening 32.

It is well known in the art that the red cell volume per unit of blood varies from individual to individual and between the sexes. The red cell volume is referred to as the hematocrit. A hematocrit can be defined as the packed red cell volume in relationship to 100 percent of the volume of blood being tested. For example, the hematocrit for women ranges from between 38 percent and 42 percent. This means for every 100 milliliters of whole blood the red blood cells will occupy 38 to 42 milliliters. The hematocrit for men, on the other hand, varies from about 41 percent to about 52 percent. Thus, the size of the container can be varied depending on the hematocrit of a particular unit of blood such that the container is essentially matched in volume to the sample being employed.

Normally a centrifuge device is sized so that the combined volume of the annulus 28 and capillary gap 26 is equal to from about 50 to 68 percent of the whole blood and more particularly is equal to about 65 percent of the whole blood that is placed into centrifuge 10 for separation. This volume will hold all of the cells from a blood sample that has a hematocrit up to 65 percent.

Obviously, centrifuge device 10 can be sized for different volumes of whole blood either by changing the volume of annulus 28 or by reducing or increasing the overall size of centrifuge device 10. Centrifuge devices have been constructed in accordance with the invention for use with from 100 to over 500 microliters (μl) of whole blood. In one instance a fingerstick was used to obtain the sample of blood for a centrifuge device 10 constructed to hold 100 μl of whole blood. After rotating the device at approximately 9,000 rpm for 60 seconds 30 μl of plasma was recovered. In another example, a larger unit designed to hold approximately 516 μl of whole blood Using the 516 μl size centrifuge device with a sample of blood which had been allowed to coagulate for 25 minutes before rotation resulted in the recovery of 100 μl of serum contrasted to the recovery of approximately 180 μl of plasma when the blood was not allowed to coagulate.

Typically, if blood to be used as the liquid sample blood is collected by any suitable means such as venipuncture and placed into anticoagulant coated vacutainer tubes in order to minimize coagulation occurring before lysing the sample in the plasma/serum separator.

In a preferred embodiment of the invention wall 24 of lower portion 20 and capillary gap 26 are joined by a barrier or lip 49 at end 25 which rises slightly above capillary gap 26. It has been found that while such a barrier is not essential superior results can sometimes be obtained when lip 49 is present in that more effective separation occurs of finely divided solid particulate material. The barrier present at the junction of the capillary gap and the inner cavity prevents particulate material present in the capillary gap from remixing with liquid in the inner cavity upon completion of the fractionation.

Figure 4:
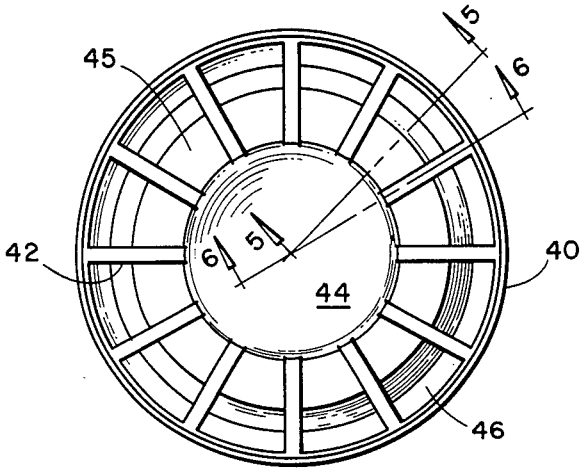
FIG. 4 is a top view of one embodiment of a compartmentalized lower portion of a centrifuge device of the present invention.
Figure 5:
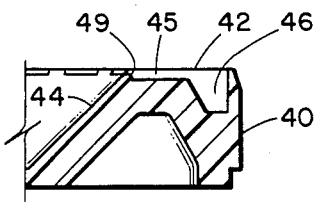
FIG. 5 is a side view, in cross section, taken along lines 5—5 in FIG. 4.

To maintain the separation which occurs during fractionation and prevent remixing of materials it is important that the slow down not be too rapid. To overcome remixing due to relative motion of the components in the lower portion, and hence remixing between plasma and solid material when using the centrifuge device with whole blood, radial vanes spaced and extending horizontally from the inner cavity of the lower portion toward the outer perimeter of the lower portion are added thereby dividing the capillary gap and, in some cases, the annulus into separate compartments. This effectively overcomes the remixing problem mentioned above. As seen in the embodiment illustrated in FIG. 4, lower portion 40 of a centrifuge device contains twelve radial vanes 42 equally spaced and extending horizontally from the inner wall 44 of lower portion 40 to the outer surface 43 of lower portion 40. The vanes 42 divide the capillary gap 45 and the annulus 46 into 12 separate compartments This is best seen in FIGS. 4 and 5. Lip 49 can be seen in FIG. 5 at the edge of wall 44 and capillary gap 45.

Figure 6:
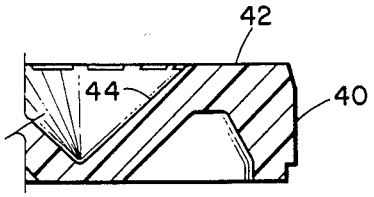
FIG. 6 is a side view, in cross section, taken along lines 6—6 in FIG. 4.
Figure 7:
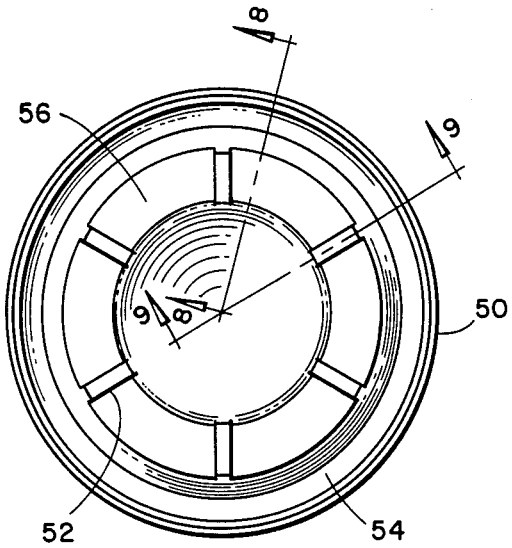
FIG. 7 is a top view of an embodiment of another compartmentalized lower portion of a centrifuge device in accordance with the present invention.
Figure 8:
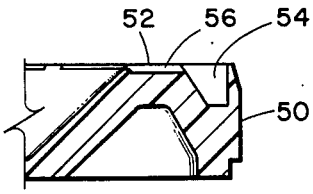
FIG. 8 is a side view, in cross section, taken along lines 8—8 in FIG. 7.
Figure 9:
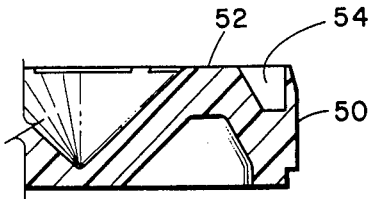
FIG. 9 is a side view, in cross section, taken along lines 9—9 in FIG. 7.

The addition of radial vanes, as illustrated in FIGS. 4 through 6, substantially eliminates the remixing problem which will bring about contamination of plasma with cells and platelets during a rapid slow down of centrifuge device 40. Thus, it is possible to achieve an overall result of substantially reducing the time for production of cell free plasma while simultaneously preventing relative motion and remixing to occur between the platelet poor plasma and the platelet enriched liquid. Without the radial vanes, the slow down period can require as long as 1 to 2 minutes. With the radial vanes, as illustrated in FIGS. 4 to 6, a slow down time of 12 to 20 seconds is normally possible Obviously, the number of radial vanes present in the lower portion of the centrifuge device is not overly critical. Two or more can be employed. In FIGS. 7 to 9 six radial vanes are disclosed which divide the capillary gap and annulus of lower portion 50 into six separate compartments. However, unlike the embodiment illustrated in FIG. 4, the radial vanes 52 of lower portion 50 do not extend into annulus 54 but only extend across capillary gap area 56. These partial radial vanes have been found to be even more effective then the full radial vanes illustrated in FIGS. 4 through 6.

Figure 10:
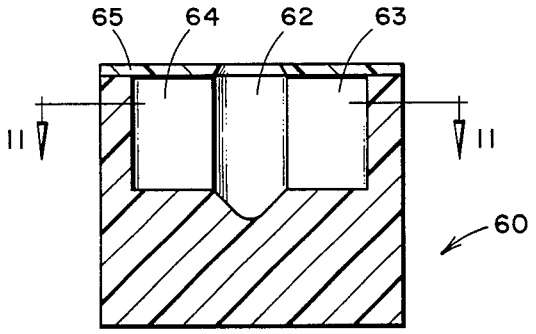
FIG. 10 is a side view, in cross section, of another embodiment according to the present invention.
Figure 11:
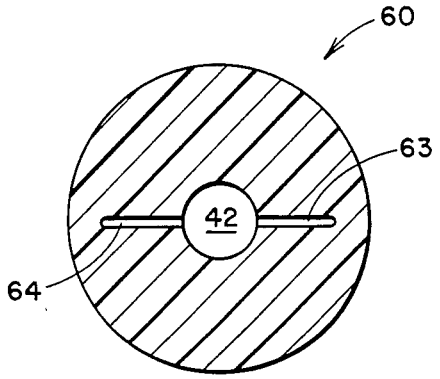
FIG. 11 is a top view, in cross section, of the centrifugal device illustrated in FIG. 10, taken along lines 11—11.

In another embodiment of the invention, illustrated in FIGS. 10 and 11, capillary gaps 63 and 64 extend vertically from a center well 62 of centrifuge device 60. This embodiment requires only a thin cover 65 due to the depth of center well 62. As centrifuge device 60 rotates, capillary gaps 63 and 64 become packed with cells and upon completion of the rotation cycle plasma or serum can be removed from the center well 62. It will be understood that any number of capillary gaps can be present and that only two have been illustrated.

The temperature at which the fractionation and separation operations occur is not critical and can be at any temperature above the freezing point or coagulation point of the material introduced. In the case of whole blood, the temperature should be above the coagulation point of the suspended red blood cells and below the denaturing point of red blood cells. Generally, such temperatures are in the range of 5° C. to 40° C. and an especially desirable temperature range is between 15° C. and 35° C.

Thus, it will be seen that the apparatus of the present invention is well adapted to attain all of the ends and objects hereinabove set forth, together with the other advantages which are inherent to the system. The apparatus has the advantages of convenience, simplicity, relatively inexpensiveness, positiveness, effectiveness, durability, accuracy and directness of action. The invention substantially overcomes problems which have existed with prior fractionation and separation devices and is essentially free of maintenance problems. The centrifugal separator and method of the present invention provide short processing times, involving low equipment and operation costs. Moreover, sterility problems are overcome. Lyses of cells (in whole blood) does not appear to occur provided the blood is fractionated without undue delay.

As mentioned above, it will be appreciated that the present is not limited to the separation of cellular components such as red blood cells from whole blood, but extends to the separation of more dense solids from a mixture of suspending fluid and/or less dense solids. Solid is defined herein as any physically separable material and includes suspended solids, colloidal solids, cells and formed elements of blood, e.g., platelets, lymphocytes, monocytes, etc.

Obviously, many other modifications and variations of the invention as hereinbefore set forth can be made without departing from the spirit and scope thereof.

What is claimed is:

1. Centrifugal device for use in fractionating and separating finely divided solid particulate material suspended in a liquid having upper and lower portions forming an inner cavity for retaining said liquid, wherein the upper and lower portions are rigid and joined together such that an elongated capillary passageway extends outwardly radially from the inner cavity of the centrifuge device to an outer cavity at the end of the elongated capillary passageway opposite said inner cavity and in which the outer cavity contains a chamber for retaining solid particulate material separated during fractionation, wherein:

said capitally passageway is between 5 and 30 thousandths of an inch in diameter;

said upper portion is sloped at an acute angle greater than about 30° to vertical;

said lower portion has conical portion forming an acute angle of 60° to 120°; and wherein the elongated capillary passageway contains a barrier at the junction of said passageway and the inner cavity which extends transversely completely across said passageway and prevents particulate material present in the elongated capillary passageway from remixing with liquid in the inner cavity upon the completion of fractionation.

2. The centrifugal device of claim 1 in which the liquid is whole blood and the combined volume of the outer cavity and the elongated capillary passageway is equal in volume to 50 to 68% of the whole blood.

3. The centrifugal device of claim 1 in which the conical lower portion forms an included angle of 90° to 120°.

4. The centrifugal device of claim 1 in which the upper portion contains an opening for the introduction of liquid into the inner cavity before fractionation and for the removal of liquid from the inner cavity following fractionation.

5. The centrifugal device of claim 1 in which the elongated capillary passageway is separated by at least one radial vane extending horizontally outward from the inner cavity thereby acting as a barrier in the elongated capillary passageway to prevent remixing of liquid upon completion of fractionation.

6. The centrifugal device of claim 5 in which the radial vane also acts as a barrier in the outer cavity.

7. Centrifugal device for use in fractionating and separating finely divided solid particulate material suspended in a liquid having upper and lower portions forming an inner cavity for retaining said liquid, wherein the upper and lower portions are rigid and joined together such that an elongated capillary passageway extends outwardly radially from the inner cavity of the centrifuge device to an outer cavity at the end of the elongated capillary passageway opposite said inner cavity and in which the outer cavity contains a chamber for retaining solid particulate material separated during fractionation, wherein:

said capillary passageway is between 5 and 30 thousandths of an inch in diameter;

said upper portion is sloped at an acute angle greater than about 40° to vertical;

said lower portion has conical portion forming an acute angle of 60° to 120°.

wherein the elongated capillary passageway contains a barrier at the junction of said passageway and the inner cavity which extends transversely completely across said passageway and prevents particulate material present in the elongated capillary passageway from remixing with liquid in the inner cavity upon the completion of fractionation; and wherein the elongated capillary passageway is separated by at least one radial vane extending horizontally outward from the inner cavity thereby acting as a barrier in the elongated capillary passageway to prevent remixing upon completion of the fractionation.

* * * * *